United States Patent [19]

Baehr, Jr. et al.

[11] 4,369,691

[45] Jan. 25, 1983

[54] PROJECTILE LAUNCHING SYSTEM WITH RESISTIVE INSERT IN THE BREECH

[75] Inventors: Frederick J. Baehr, Jr., Murrysville Boro; George A. Kemeny, Wilkins Township, Allegheny County, both of Pa.; John P. Barber, Kettering, Ohio

[73] Assignee: Westinghouse Electric Corp., Pittsburgh, Pa.

[21] Appl. No.: 185,706

[22] Filed: Sep. 10, 1980

[51] Int. Cl.[3] ..... F41F 1/00

[52] U.S. Cl. ..... 89/8; 124/3

[58] Field of Search ..... 89/8; 124/3; 307/112, 307/139, 143; 318/135; 310/12–14, 302

[56] References Cited

U.S. PATENT DOCUMENTS 1,370,020 2/1921 Fauchon-Villeplee ..... 89/8

OTHER PUBLICATIONS

J. Appl. Phys., 49(4), (4/78), pp. 2540–2542, Rashleigh et al.

EP-T12, (3/72), Accel. of Macroprtl. & Hpervel., EM Accel. Barber, pp. 90–123, Australian National University.

*Primary Examiner*—Sal Cangialosi

*Attorney, Agent, or Firm*—F. J. Baehr, Jr.

[57] ABSTRACT

Resistive inserts are disposed in the breech of a projectile launcher to prevent excessive premature heating, to prevent premature movement of the projectile armature, and to prevent welding of the armature to the projectile rails during the period while the current builds up to the launching magnitude.

16 Claims, 2 Drawing Figures

PROJECTILE LAUNCHING SYSTEM WITH RESISTIVE INSERT IN THE BREECH

CROSS REFERENCE TO RELATED APPLICATIONS

An application entitled "A Switching System" filed by the assignee on Dec. 14, 1979, and assigned Ser. No. 100,302 provides a background for this invention and is hereby incorporated by reference.

An application entitled "Projectile Launching System With Assured Current Division" is being filed concurrently herewith and is hereby incorporated by reference.

BACKGROUND OF THE INVENTION

This invention relates to electromagnetic projectile launchers and more particularly to a launching system with resistive inserts in the breech. A launching system utilizing two sets of parallel rails wherein one set of rails provides switching and the other set of parallel rails is utilized for launching the projectile and the rails of each portion are connected respectively to the rails of the other portion, has several advantages as once the current has been switched, injected or commutated to the launching rails, the switching armature no longer carries current and can be discharged from the switching rails or it can pass over an insulated portion of the rails or into an insulated bore eliminating the electromagnetic forces thereon and generally reducing the complexity and cost of the components required to decelerate the switching armature. The problem with such a system is preventing premature movement and excessive premature heating of the projectile armature during the charging cycle.

SUMMARY OF THE INVENTION

In general, an electromagnetic projectile launching system, when made in accordance with this invention, comprises: a pair of conductive rails, means for conducting current between the rails and for propelling a projectile, a high current source, means for commutating the current from the current source to the rails, a resistance initially disposed between the current source and the means for conducting current between the rails and for propelling a projectile. The resistance is only in the circuit at the commencement of the movement of the projectile.

BRIEF DESCRIPTION OF THE DRAWINGS

The objects and advantages of this invention will become more apparent from reading the following detailed description in conjunction with the accompanying drawings, in which.

DESCRIPTION OF THE PREFERRED EMBODIMENT

Figure 1:
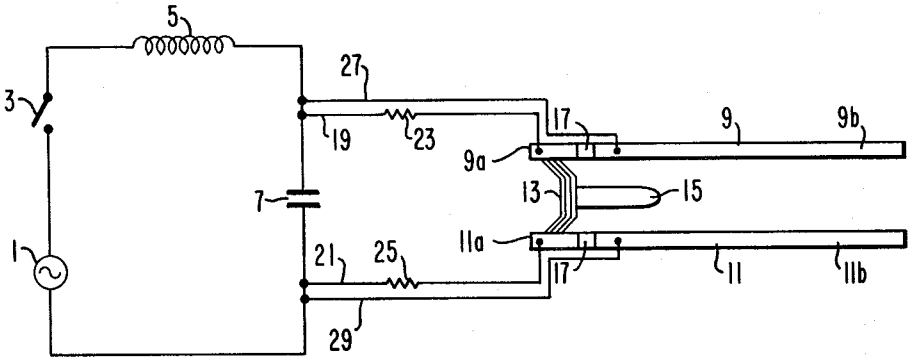
FIG. 1 is a schematic diagram of an electromagnetical launching system made in accordance with this invention.

Referring now to the drawings in detail and in particular to FIG. 1, there is shown a schematic diagram of an electromagnetic projectile launching system, which comprises a series circuit having a supply or source of high current such as a homopolar generator 1 or other generating means, a make-switch 3, an induction coil or other inductive energy storage means 5 and a circuit breaking means 7, capable of commutating and then interrupting a current which may initially be exceedingly high, for example, $1\frac{1}{2}$ million amps. Also shown are a pair of conductive rails 9 and 11, with an armature 13 or other means for conducting a current between the rails and for accelerating a projectile 15 along the rails 9 and 11. The rails 9 and 11 have a short leading end portion or breech **9*a* and 11*a* and a far longer accelerating portion 9*b* and 11*b* separated by insulators 17. Leads 19 and 21 connect the leading end portions of the rail 9*a* and 11*a* across the circuit breaker means 7 and resistances 23 and 25 are disposed, respectively, in the leads 19 and 21. The leading end portion 9*a* and 11*a* may be made at least in part of a material having higher resistance and of a material which will not weld to the armature such as a carbonous material. The resistances 23 and 25 are combined to produce a resistance which may be in the order of 30 micro-ohms and which acts to prevent premature movement or excessive heating of the armature 13 while the induction coil 5** is being energized or during the interval of time required for the current to reach the launching magnitude.

Leads 27 and 29 connect the accelerating portion of the rails **9*b* and 11*b* across the circuit breaker means 7 and the leads 27 and 29 have no added resistance, thereby taking the resistances 23 and 25 out of the launching circuit shortly after commencement of the launch. The leads 19 and 27 and 21 and 29** are disposed in close proximity to assist in the commutation of current from the breech to the accelerating portions of the rail.

Figure 2:
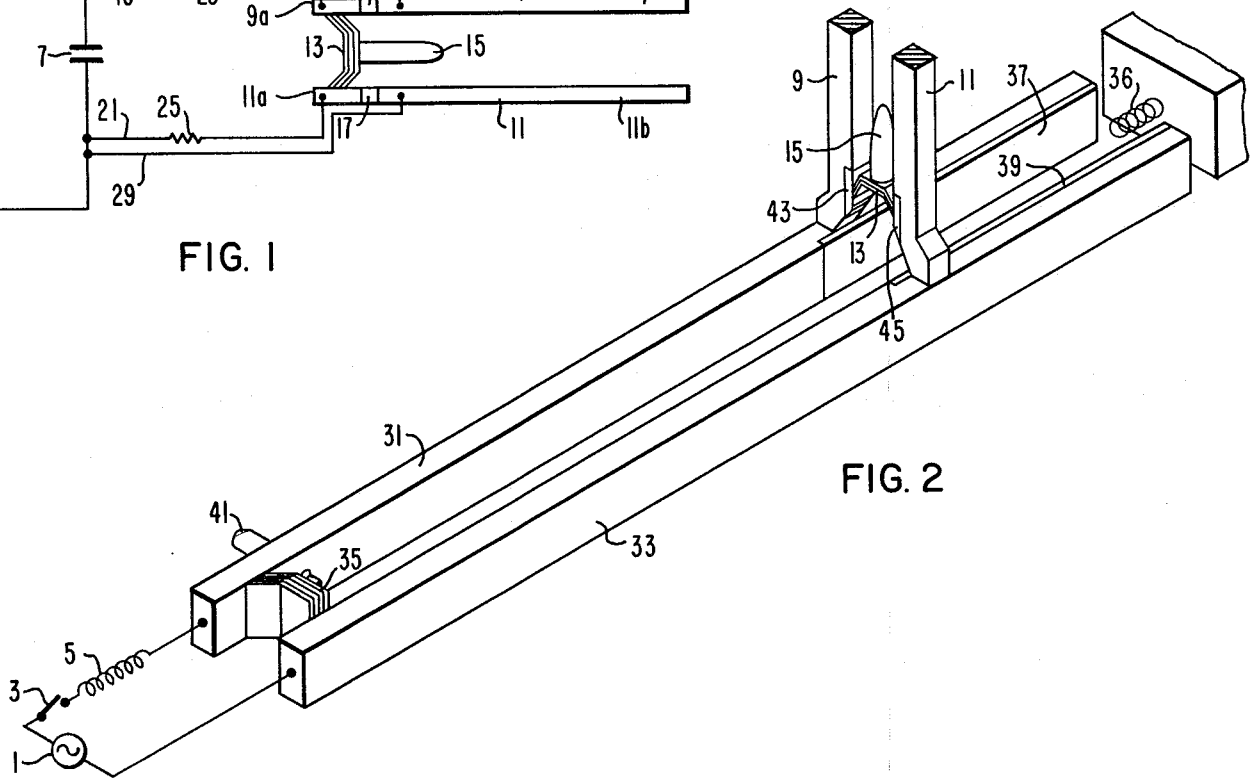
FIG. 2 is a schematic diagram of an alternative embodiment of the launching system.

The launching system shown in FIG. 2 is similar to the launching system shown in FIG. 1, the homopolar generator 1 is counted in series with make-switch 3 and the induction coil 5. The projectile 15 and projectile armature 13 are slidably disposed between the conductive rails 9 and 11, however, in FIG. 2 the circuit breaker or commutating means comprises a second set of parallel conductive rails 31 and 33 and a switching armature 35 or other means (including an arc) for conducting current between the rails 31 and 33 and an energy absorbing means 36 disposed to stop the switching armature 35. Insulating strips 37 and 39 are disposed on the rails 31 and 33, respectively, adjacent the attachment to the first set of rails and means 41 for holding the switching armature 35 is disposed adjacent the leading end of the rails 31 and 33 to prevent premature movement of the switching armature 35.

Another difference shown in FIG. 2 is resistive inserts 43 and 45 are disposed adjacent the leading or breech end of the conductive rails 9 and 11. The resistive inserts 43 and 45 are disposed so that they contact the projectile armature 13 and are only interposed between the armature 13 and the current source during the period when the induction coil 5 is being charged and once the armature 13 and projectile 15 have moved a short distance, the resistive inserts 43 and 45 are no longer in the circuit. The resistive inserts produce in the order of 30 micro-ohms of resistance and are made of a carbonaceous or other material, which will not weld to the projectile armature 13 as charging current is applied to the induction coil 5 and as commutation of the driving current commences, in order to inhibit any possibility of local welding between the projectile armature 13 and the conductive rails 9 and 11.

Placing the resistive inserts 43 and 45 so that they are out of the circuit right after the armature 13 and projectile 25 begin to move can reduce the energy dissipated in the resistive inserts by a factor of at least 20 or 30 to 1 compared to resistances remaining in the circuit during the entire launch and during current decay after launch. This means also that the resistors per this invention can be made smaller and less costly than resistors which remain in the circuit during the launching phase.

The operation of the electromagnetic projectile launching system hereinbefore described is as follows:

The make-switch 3 is closed allowing the homopolar generator 1 to produce a current, which flows through the induction coil 5 and builds up to a predetermined level, which may be in the neighborhood of 1½ million amps. In the FIG. 1 circuit, the current flows through the initially closed circuit breaker means 7, while in the FIG. 2 circuit, the rails 31 and 33 and armature 35 serve as a switch or circuit breaking means and take the original flow of current during the current buildup portion of the launch.

In FIG. 1 the projectile rails 9 and 11 have a leading end portion and a longer launching or trailing end portion separated by insulators 17. The leading end portion 9*a* and 11*a* are connected across the circuit breakers 7 by the leads 19 and 21, which have a resistance 23 and 25, respectively, disposed therein. The resistance is sufficient to prevent excessive parasitic current flow, which in turn prevents premature movement and excessive heating of the projectile armature 13 while the circuit breaker 7 is closed and current is building up to the desired launching level. When the circuit breaker 7 starts to open, current is rapidly commutated to the leading rail portions 9*a* and 11*a* to initiate movement of the projectile armature 13. As the projectile armature 13 moves, it leaves the leading end portions 9*a* and 11*a* and moves to the launching portions 9*b* and 11*b*, and the resistance 23 and 25 is out of the circuit as current flows to the launching portions of the rails 9*b* and 11*b* via the leads 27 and 29 to accelerate the projectile armature 13 and projectile 15.

In the FIG. 2 system, as the current builds up to a predetermined level, which may, for example, be 1½ million amps, the resistive inserts 43 and 45 provide sufficient resistance to prevent premature movement and excessive heating of the projectile armature 13 as current flows from the homopolar generator 1 through the make-switch 3, induction coil 5, through the switching rail 31, the switching armature 35, and the switching rail 33. To initiate firing, the switching armature 35 is released by the holding means 41 and progresses along the rails 31 and 33. As it reaches the insulated portions disposed on the rails or the insulated bore, current is rapidly commutated to the launching rails 9 and 11 and also through the resistive inserts 43 and 45 to the projectile armature 13 causing the armature 13 to begin to move along the rails 9 and 11. As the armature 13 begins to move, it leaves the resistive inserts 43 and 45 removing the resistance from the circuit allowing the current to flow through the rails 9 and 11 and armature 13 with a minimal amount of resistance to accelerate the projectile efficiently. Since the resistive inserts 41 and 43 are made of a carbonous or other material, which will not weld to the projectile armature 13, not even local spot welding can take place as the current is built up in the induction coil 5.

The electromagnetic projectile launcher system hereinbefore described and utilizing resistive inserts temporarily series connected in the projectile breech circuit to prevent premature projectile launching and premature excessive projectile armature heating advantageously results in: the prevention of welding of the armature to the rails during the current buildup; being able to use far less massive and less expensive inserts because they are subjected only to minor current flow during the current buildup and massive current flow during only the first few centimeters of armature travel; and resulting also in higher efficiency because if the resistive inserts are in the circuit during the whole projectile launching phase, then the ohmic losses in the inserts will be far higher, thus wasting system energy.

We claim:

1. An electromagnetic projectile launching system comprising:

a pair of conductive rails;

means for conducting current between said rails and for propelling a projectile from the leading ends of said rails to the other ends;

a high current source;

means for switching current from said current source to said rails;

and a resistance electrically connected between said switching means and said means for conducting current between said rails and for propelling a projectile so that the resistance is only in the circuit during the initial movement at the leading ends of the rails of the means for conducting current between the rails and for propelling the projectile.

2. An electromagnetic projectile launching system as set forth in claim 1, wherein the resistance is a resistive insert disposed in at least one of the conductive rails adjacent the leading end thereof.

3. An electromagnetic projectile launching system as set forth in claim 1, wherein the resistance is a resistive insert disposed in each rail adjacent the leading end thereof.

4. An electromagnetic projectile launching system as set forth in claim 3, wherein the resistive insert is made of a carbonous material.

5. An electromagnetic projectile launching system as set forth in claim 3, wherein the resistive insert is made of a material which will prevent welding between the resistive insert and the means for conducting current between the rails and for propelling the projectile.

6. An electromagnetic projectile launching system as set forth in claim 3, wherein the means for conducting current between the rails and for propelling a projectile is an armature slidably disposed between the rails.

7. An electromagnetic projectile launching system as set forth in claim 3, wherein the resistive inserts are made of a carbonous material.

8. An electromagnetic projectile launching system as set forth in claim 3, wherein the resistive insert is made of a material which will not weld to the means for conducting current between the rails and for propelling a projectile.

9. An electromagnetic projectile launching system as set forth in claim 2, wherein the means for conducting current between the rails and propelling a projectile is an armature slidably disposed between the rails.

10. An electromagnetic projectile launching system comprising:

a pair of conducting rails;

at least one of said rails having a leading end electrically insulated from the remainder of said one rail;

a high current source;

means for conducting current between said rails and for propelling a projectile;

means for switching current from said current source to said rails electrically connected to the leading end of said one rail and to the remainder of said one rail;

and added impedance electrically connected between said leading end of said rail and either said switching means or said means for conducting current between said rails and for propelling a projectile.

11. An electromagnetic projectile launching system as set forth in claim 10, wherein the impedance is substantially resistive.

12. An electromagnetic projectile launching system as set forth in claim 10 wherein the leading end portion of the one rail is made at least in part of a carbonous material.

13. An electromagnetic projectile launching system as set forth in claim 10, wherein the leading end of each rail is electrically insulated from the remainder of the rail.

14. An electromagnetic projectile launching system as set forth in claim 13 wherein the leading end portion of each rail is made of a material which will not weld to the means for conducting a current between the rails and for propelling a projectile.

15. An electromagnetic projectile launching system as set forth in claim 14, wherein the leading end of each rail is made at least in part of a carbonous material.

16. An electromagnetic projectile launching system as set forth in claim 15, wherein the carbonous material provides the added impedance.

* * * * *